US012553161B2

(12) United States Patent
Tsuji

(10) Patent No.: US 12,553,161 B2
(45) Date of Patent: Feb. 17, 2026

(54) DOUBLE RASCHEL KNITTED FABRIC AND UPHOLSTERY MATERIAL CONTAINING SAME

(71) Applicant: Asahi Kasei Kabushiki Kaisha, Tokyo (JP)

(72) Inventor: Yusuke Tsuji, Tokyo (JP)

(73) Assignee: Asahi Kasei Kabushiki Kaisha, Tokyo (JP)

( * ) Notice: Subject to any disclaimer, the term of this patent is extended or adjusted under 35 U.S.C. 154(b) by 0 days.

(21) Appl. No.: 18/565,617

(22) PCT Filed: May 30, 2022

(86) PCT No.: PCT/JP2022/021954
§ 371 (c)(1),
(2) Date: Nov. 30, 2023

(87) PCT Pub. No.: WO2022/255309
PCT Pub. Date: Dec. 8, 2022

(65) Prior Publication Data

US 2024/0254666 A1 Aug. 1, 2024

(30) Foreign Application Priority Data

Jun. 1, 2021 (JP) ..... 2021-092254

(51) Int. Cl.
*D04B 21/06* (2006.01)
*D04B 21/16* (2006.01)

(52) U.S. Cl.
CPC ..... *D04B 21/06* (2013.01); *D04B 21/16* (2013.01); *D10B 2403/0222* (2013.01); *D10B 2505/08* (2013.01)

(58) Field of Classification Search
None
See application file for complete search history.

(56) References Cited

U.S. PATENT DOCUMENTS 5,731,062 A * 3/1998 Kim ..... D04B 1/18 428/167
6,758,068 B2 * 7/2004 Shirasaki ..... D04B 21/16 66/170

(Continued)

FOREIGN PATENT DOCUMENTS

CN 103388236 A 11/2013
CN 207210654 U 4/2018

(Continued)

OTHER PUBLICATIONS

Supplementary European Search Report issued in European Patent Application No. 22816056.0 dated May 7, 2024.

(Continued)

*Primary Examiner* — Grace Huang
(74) *Attorney, Agent, or Firm* — Morgan, Lewis & Bockius LLP

(57) ABSTRACT

Provided are a double raschel knitted fabric having ridges, wherein shape stability of ridges and recesses, seam strength, and tensile resistance of recesses are excellent, and a surface covering material comprising said fabric. The double raschel knitted fabric according to the present invention includes a double-layer knitted fabric having a surface layer and a back layer, and a connecting thread that connects the knitted fabric of the two front and back layers, and a plurality of ridges, and recesses located between the ridges, are formed in at least one knitted fabric of the two front and back layers, the double raschel knitted fabric characterized in that the ridges are formed by combining two or more wales of stitch rows continuing in the warp direction, and the ridges are connected to adjacent ridges on at least one side by sinker loops.

8 Claims, 5 Drawing Sheets

(56) References Cited

U.S. PATENT DOCUMENTS

| | | | | |
|---|---|---|---|---|
| 2003/0101776 | A1 | 6/2003 | Shirasaki et al. | |
| 2008/0280094 | A1 | 11/2008 | Wildeman et al. | |
| 2014/0041141 | A1* | 2/2014 | Clarke | D04B 21/02 15/228 |
| 2018/0179676 | A1 | 6/2018 | Takahashi et al. | |
| 2019/0008623 | A1 | 1/2019 | Nemoto et al. | |
| 2019/0112735 | A1* | 4/2019 | Weng | D04B 1/102 |
| 2021/0130993 | A1 | 5/2021 | Mizukami et al. | |

FOREIGN PATENT DOCUMENTS

| | | | | |
|---|---|---|---|---|
| CN | 110662860 | A | 1/2020 | |
| DE | 19910785 | A1 | 9/2000 | |
| EP | 0687949 | A1 | 12/1995 | |
| EP | 2474653 | A1 * | 7/2012 | D04B 1/22 |
| GB | 2352735 | A * | 2/2001 | A47C 27/006 |
| JP | H05-049552 | A | 3/1993 | |
| JP | H11-323705 | A | 11/1999 | |
| JP | 2002-138352 | A | 5/2002 | |
| JP | 3088807 | U | 10/2002 | |
| JP | 2003-013346 | A | 1/2003 | |
| JP | 2003-113562 | A | 4/2003 | |
| JP | 2003-183957 | A | 7/2003 | |
| JP | 2004-190191 | A | 7/2004 | |
| JP | 2004-232109 | A | 8/2004 | |
| JP | 2004-270079 | A | 9/2004 | |
| JP | 2008-025508 | A | 2/2008 | |
| JP | 3139758 | U | 2/2008 | |
| JP | 2008-255508 | A | 10/2008 | |
| JP | 2013-011030 | A | 1/2013 | |
| JP | 2013-129928 | A | 7/2013 | |
| JP | 2015-010283 | A | 1/2015 | |
| JP | 2016-084550 | A | 5/2016 | |
| JP | 5939782 | B2 * | 6/2016 | D04B 21/16 |
| KR | 20-0378068 | Y1 | 3/2005 | |
| KR | 10-2006-0061893 | A | 6/2006 | |
| KR | 10-2014-0090899 | A | 7/2014 | |
| KR | 10-2018-0102083 | A | 9/2018 | |

OTHER PUBLICATIONS

International Search Report issued in corresponding International Patent Application No. PCT/JP2022/021954 dated Jul. 19, 2022.

International Preliminary Report on Patentability and Written Opinion issued in corresponding International Patent Application No. PCT/JP2022/021954 dated Dec. 14, 2023.

* cited by examiner

DOUBLE RASCHEL KNITTED FABRIC AND UPHOLSTERY MATERIAL CONTAINING SAME

FIELD

The present invention relates to a double Raschel knitted fabric and a surface covering material.

BACKGROUND

Double raschel knitted fabrics constructed with front/back double-layer knitted fabrics and connecting thread that connects the double-layer knitted fabrics employ monofilaments as the connecting thread and thus have a cushioning property in the thickness direction, while the front and back knitted fabrics also have a ridge structure, and consequently they are widely used as highly designed cushion materials for a variety of articles including seat sheets and beddings.

For example, for imparting a ridged-shaped design property to a front layer knitted fabric double Raschel knitted fabric, PTL 1 discloses a ridged-shaped double Raschel knitted fabric having no distortion of the ridges, no deviation in the course direction of the ridges, and satisfactory shape stability of the ridges, by knitting in such a manner that insertion threads distributed at a ratio of one thread per ridge row are inserted and secured at the edge of each ridge for each course in a predetermined swing width, with the insertion threads being bridged and inserted between adjacent ridges in at least some of the courses and secured at the outer ends of both ridges, in order to bind together the stitch rows that form the ridges.

CITATION LIST

Patent Literature

[PTL 1] Japanese Unexamined Patent Publication No. 2008-255508

SUMMARY

Technical Problem

With the double Raschel knitted fabric of PTL 1, however, the insertion threads tend to slip when strong tensile force has been applied in the course direction (weft direction) of the ridges or recesses, resulting in unsatisfactory durable properties, including seam strength and tensile resistance of the recesses.

In light of these problems of the prior art, the problem to be solved by the invention is to provide a double Raschel knitted fabric with ridges, having excellent shape stability of the ridges and recesses, excellent seam strength and excellent tensile resistance of the recesses, as well as a surface covering material comprising said fabric.

Solution to Problem

The present inventors have conducted much research with the goal of solving the problem described above, and as a result have completed this invention upon finding that the problem can be solved by a double Raschel knitted fabric including a front/back double-layer knitted fabric and connecting thread connecting together the front/back double-layer knitted fabric, and having a plurality of ridges formed in at least one layer of the front/back double-layer knitted fabric, wherein the ridges are formed by two or more wales of stitch rows converged together in the warp direction, and the ridges are linked with adjacent ridges on at least one side by sinker loops.

Specifically, the present invention provides the following.

[1] A double Raschel knitted fabric including a front/back double-layer knitted fabric, comprising a front layer and a back layer, and connecting thread connecting together the front/back double-layer knitted fabric, and having a plurality of ridges and recesses between the ridges, formed in at least one layer of the front/back double-layer knitted fabric, wherein the ridges are formed by two or more wales of stitch rows converged together in the warp direction, and the ridges are linked with adjacent ridges on at least one side by sinker loops.

[2] The double Raschel knitted fabric according to [1] above, wherein for each ridge, the left-half stitch row is connected to the right ridge adjacent to that ridge and the right-half stitch row is connected to the left ridge adjacent to that ridge, with a sinker loop, in a manner sandwiching 0 to 1 stitch.

[3] The double Raschel knitted fabric according to [2] above, wherein for each ridge, the left-half stitch row is connected to the right ridge adjacent to that ridge and the right-half stitch row is connected to the left ridge adjacent to that ridge, with a sinker loop, without sandwiching a stitch.

[4] The double Raschel knitted fabric according to any one of [1] to [3] above, which includes in the knitted fabric on the side where the ridges are formed, a plurality of non-ridges in which two or more courses composed of a knitted texture without recesses are continuously formed, the non-ridges adjacent in the warp direction being separated by two or more courses.

[5] The double Raschel knitted fabric according to any one of [1] to [4] above, wherein in the ridges, one or more courses every 9 courses are connected with their adjacent ridges by sinker loops.

[6] The double Raschel knitted fabric according to [5] above, wherein in the ridges, one or more courses every 3 courses are connected with their adjacent ridges by sinker loops in a manner sandwiching 0 to 1 stitch.

[7] The double Raschel knitted fabric according to [5] above, wherein in the ridges, all of the courses are connected with their adjacent ridges by sinker loops in a manner sandwiching 0 to 1 stitch.

[8] The double Raschel knitted fabric according to any one of [1] to [7] above, wherein the air permeability from the back layer side toward the knitted fabric on the front layer side is 50 $cc/cm^2/sec$ or greater.

[9] A surface covering material which includes a double Raschel knitted fabric according to any one of [1] to [8] above.

[10] surface covering material including a double Raschel knitted fabric according to [3] above, wherein in the ridges, all of the courses are connected with their adjacent ridges by sinker loops.

Advantageous Effects of Invention

The ridged-shaped double Raschel knitted fabric and surface covering material comprising it according to the invention have excellent shape stability of the ridges and recesses, excellent seam strength and excellent tensile resistance of the recesses.

DESCRIPTION OF EMBODIMENTS

Figure 1:
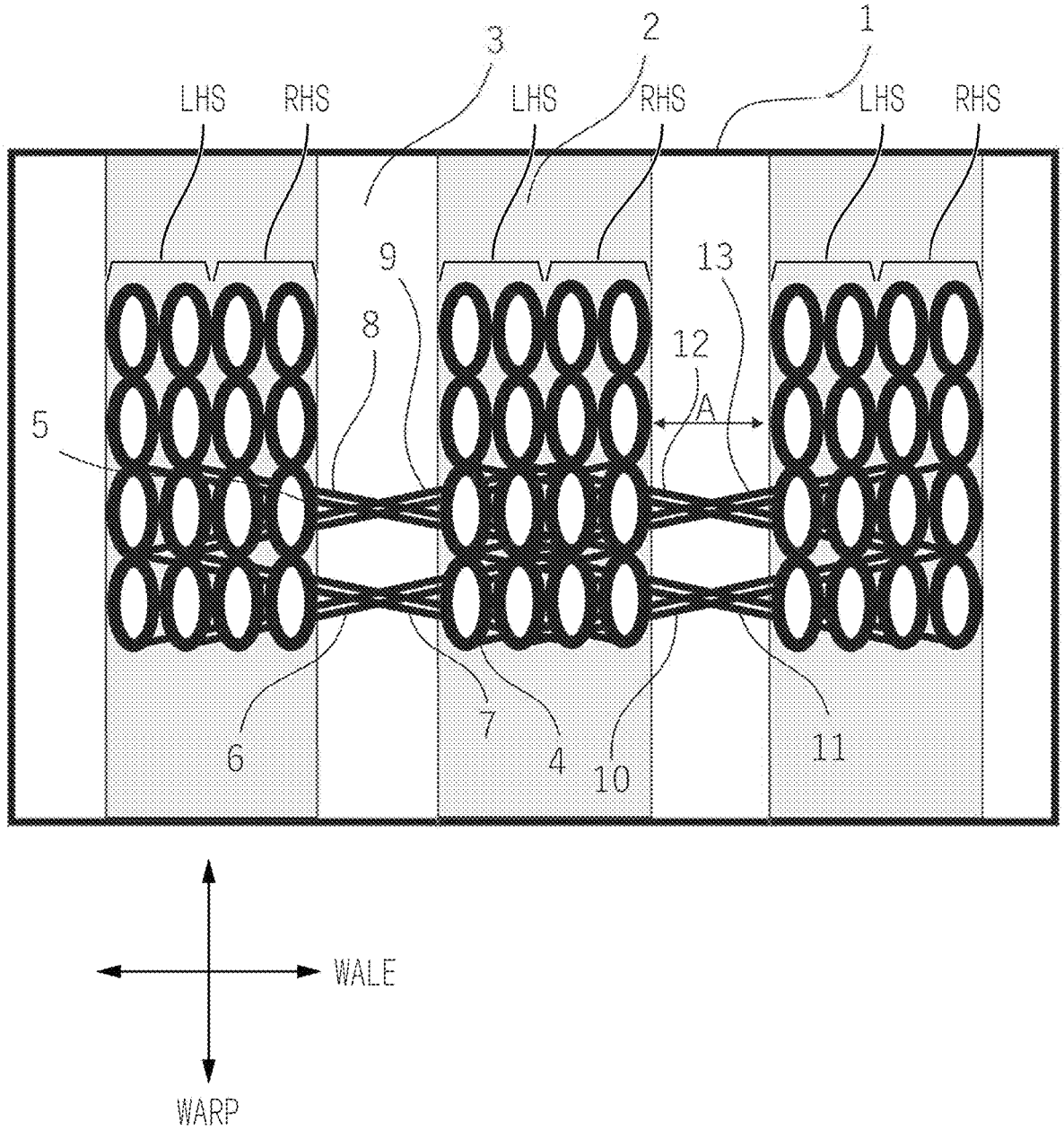
FIG. 1 is a schematic view showing an example of ridges formed in a front layer knitted fabric. (Some of the sinker loops are not shown.)

The invention will now be explained in detail using an embodiment.

One embodiment of the invention is a double Raschel knitted fabric including a front/back double-layer knitted fabric, comprising a front layer and a back layer, and connecting thread connecting together the front/back double-layer knitted fabric, and having a plurality of ridges and recesses sandwiched between the ridges, formed in at least one layer of the front/back double-layer knitted fabric, wherein the ridges are formed by two or more wales of stitch rows converged together in the warp direction, and the ridges are linked with adjacent ridges on at least one side by sinker loops.

The double Raschel knitted fabric of the embodiment is a double Raschel knitted fabric composed of a front/back double-layer knitted fabric and connecting thread that connects the double-layer knitted fabric. The double Raschel knitted fabric is knitted with a double Raschel warp knitting machine, the knitting machine gauge preferably being 18 to 28 gauge.

The double Raschel knitted fabric of the embodiment has a plurality of ridges and recesses between the ridges, on at least one layer of the front/back double-layer knitted fabric. The ridges of the embodiment are sections where two or more wales of stitch rows are converged together in the warp direction in the front layer or back layer knitted fabric, in some or all of the courses. Adjacent ridges also form recesses across gaps in the course direction (weft direction). The stitch rows in the warp direction forming the ridges must converge over two or more wales, but from the viewpoint of shape retention, they preferably converge over 4 or more wales, while from the viewpoint of the design property, they preferably converge over 4 or more wales and 8 or fewer wales. The gaps between adjacent ridges (recess widths) are preferably 0.5 mm or greater and more preferably 0.8 mm or greater, for a superior visual design property.

The ridges are connected with their adjacent ridges on at least one side by sinker loops. Such a structure will stabilize the shapes of the ridges and recesses and increase the seam strength or the tensile resistance of the recesses.

Any method may be used to form the ridges. For example, when using at least two guide bars of the knitting machine and supplying yarn from the guide bars, it is preferred to use a method of providing a 1-in, 1-out or a 2-in, 2-out thread arrangement and, for at least two stitch rows running in the lengthwise direction (warp direction) of a knitted fabric supplied from two guide bars, causing convergence of the stitch rows to produce a convex ridge structure, by creating a state of directly or indirectly pulling the stitch row on the left side in the right direction and the stitch row on the right side in the left direction by a sinker loop, due to the movement of the two guide bars. In other words, for each ridge of the knitted fabric of the embodiment, the left-half stitch row (LHS) is connected to the right ridge adjacent to that ridge and the right-half stitch row (RHS) is connected to the left ridge adjacent to that ridge, with a sinker loop, in a manner sandwiching 0 to 1 stitch. The sinker loop connecting adjacent ridges may connect from any stitch row to any stitch row of the adjacent ridge, and two sinker loops extending from a single stitch may extend in the same direction from the stitch or it may extend in the opposite direction left or right. As used herein, the terms "left" and "right" are used to indicate relative positional relationships in the weft direction of the knitted fabric. When the number of stitch rows forming a single ridge is odd, the stitch row on the left side of the center row is the "left-half stitch row" and the stitch row on the right side of the center stitch row is the "right-half stitch row", while the center stitch row is neither the "left-half stitch row" nor the "right-half stitch row".

FIG. 1 shows an example of a knitted fabric 1 of the embodiment, having ridges 2 formed by 4 stitch rows. The sinker loops 8, 13 and 6, 11 pull the two right-left stitch rows of the 4 stitch rows of the ridge 2 in opposite right-left directions, causing gathering of the stitch rows to form a convex (recess 3) ridge 2 structure, the sinker loops 6, 7, 8, 9, 10, 11, 12 and 13 being connected to the adjacent ridges, with one stitch 4 in the ridge 2 facing the recess 3, and other stitch 5 in the ridge 2 on its left adjacent to that ridge 2 containing the one stitch 4 facing the recess 3.

From the viewpoint of further stabilizing the shapes of the ridges and recesses, and of increasing the seam strength and tensile resistance of the recesses, the ridges of the embodiment are preferably connected with their adjacent ridges by the sinker loops in a manner sandwiching 0 to 1 stitch, in one or more courses every 9 courses, more preferably they are connected with their adjacent ridges in one or more courses every 3 courses, and most preferably they are connected with their adjacent ridges in all of the courses.

The seam strength of the double Raschel knitted fabric is preferably 500 N or greater for adequate performance when the fabric is used as a surface covering material, while from the viewpoint of shape retention, the amount of tensile deformation, representing the tensile resistance of the recesses, is preferably 1.5 mm or lower.

According to the embodiment, the ridges may all have the same ridge structure throughout all of the courses of the knitted fabric, or they may have a structure with a combination of different knitted textures in some of the courses.

According to the embodiment, if the knitted fabric on the side on which the ridges are formed includes non-ridges 14 formed continuously in two or more courses composed of a knitted texture without recesses, with the non-ridges 14 adjacent in the warp direction separated by two or more courses, then it is possible to create a block—or checkered—like outer appearance.

Figure 2:
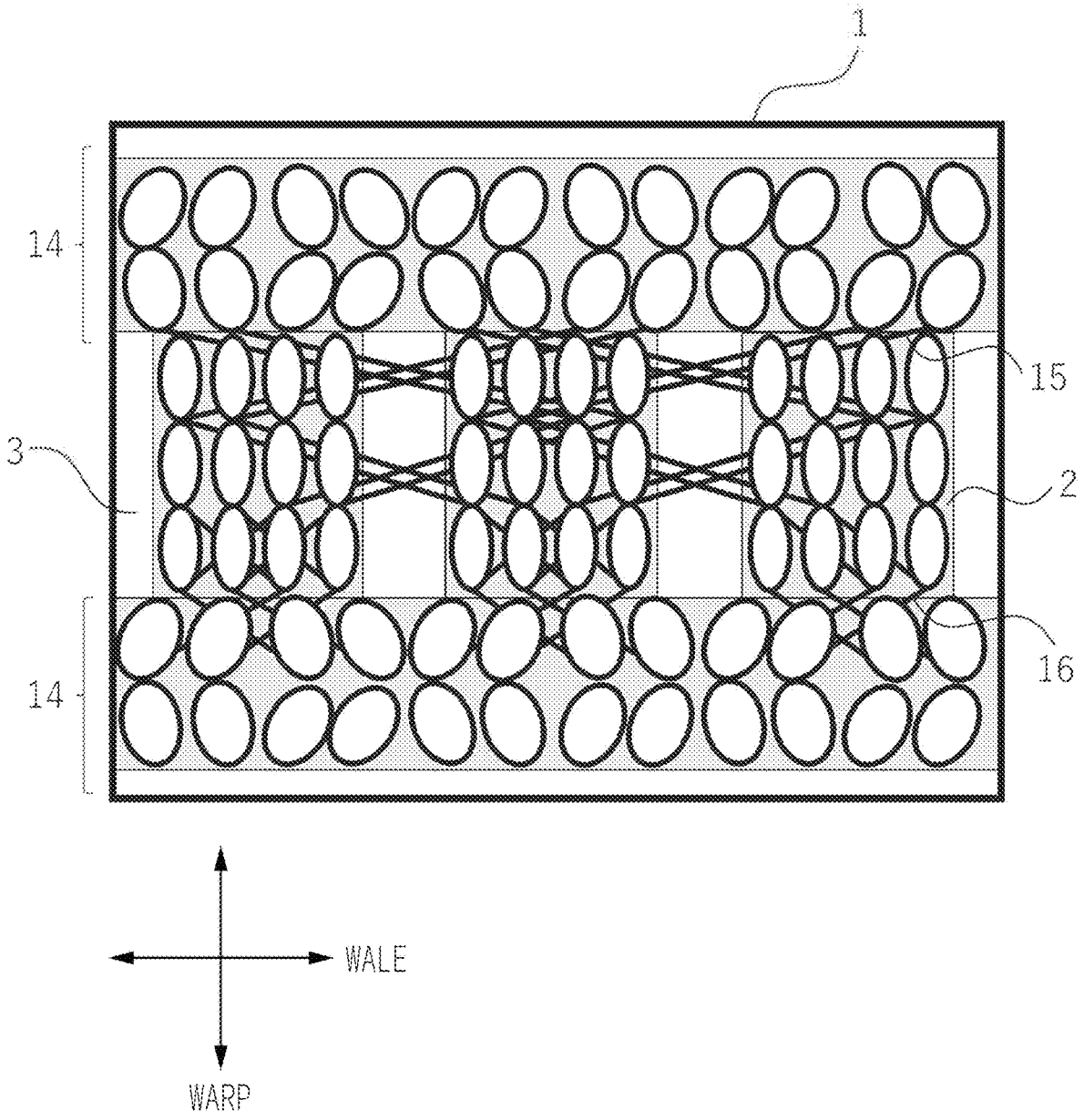
FIG. 2 is a schematic view showing an example of ridges and non-ridges formed in a front layer knitted fabric. (Some of the sinker loops are not shown.)
Figure 3:
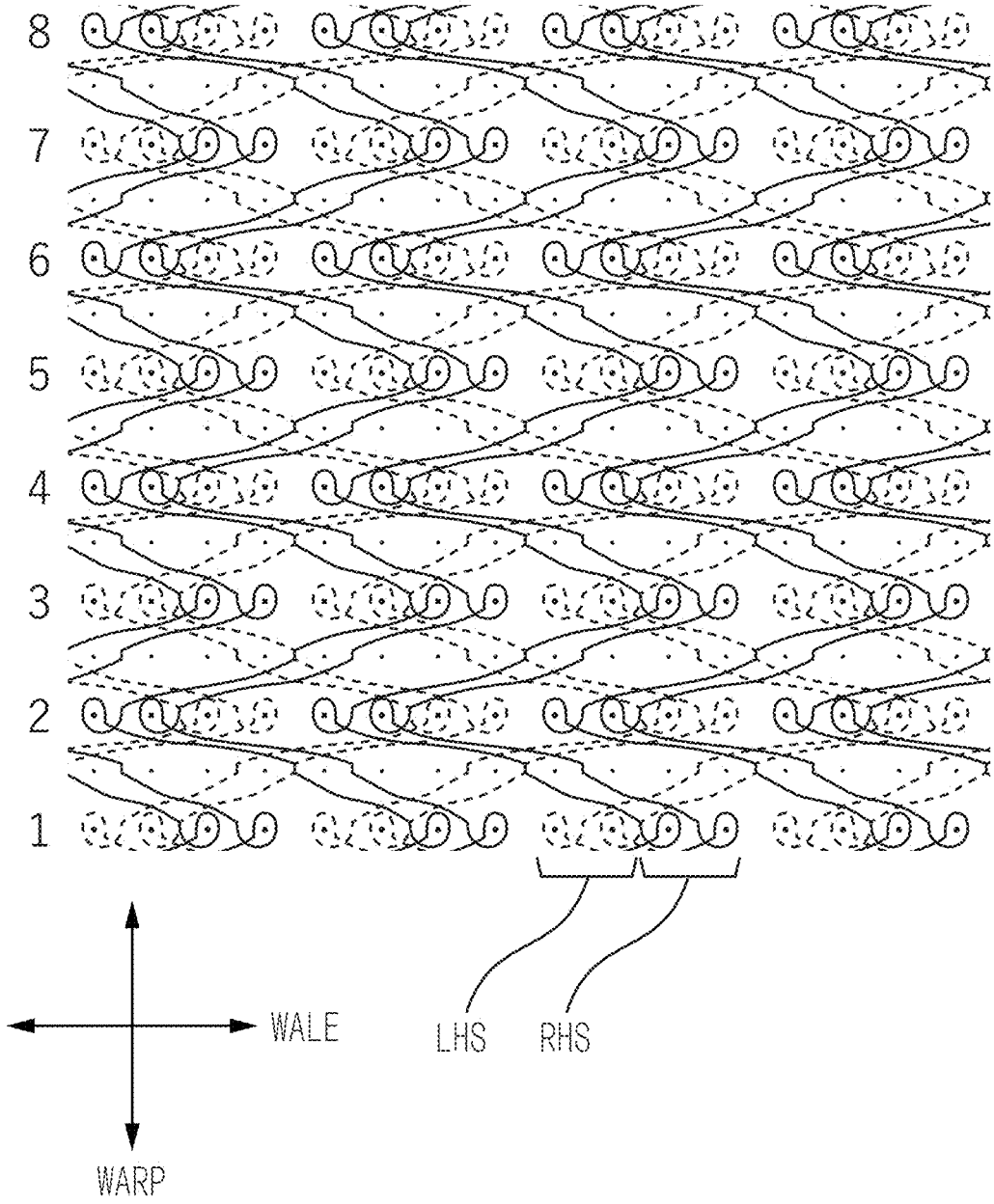
FIG. 3 is a knitting diagram for the double Raschel knitted fabric of Example 1. Each left-half stitch row of a ridge is connected to the ridge that is adjacent to the right of that ridge and each right-half stitch row of a ridge is connected to the ridge that is adjacent to the left of that ridge, with a sinker loop, sandwiching 0 stitches (without sandwiching a stitch).
Figure 4:
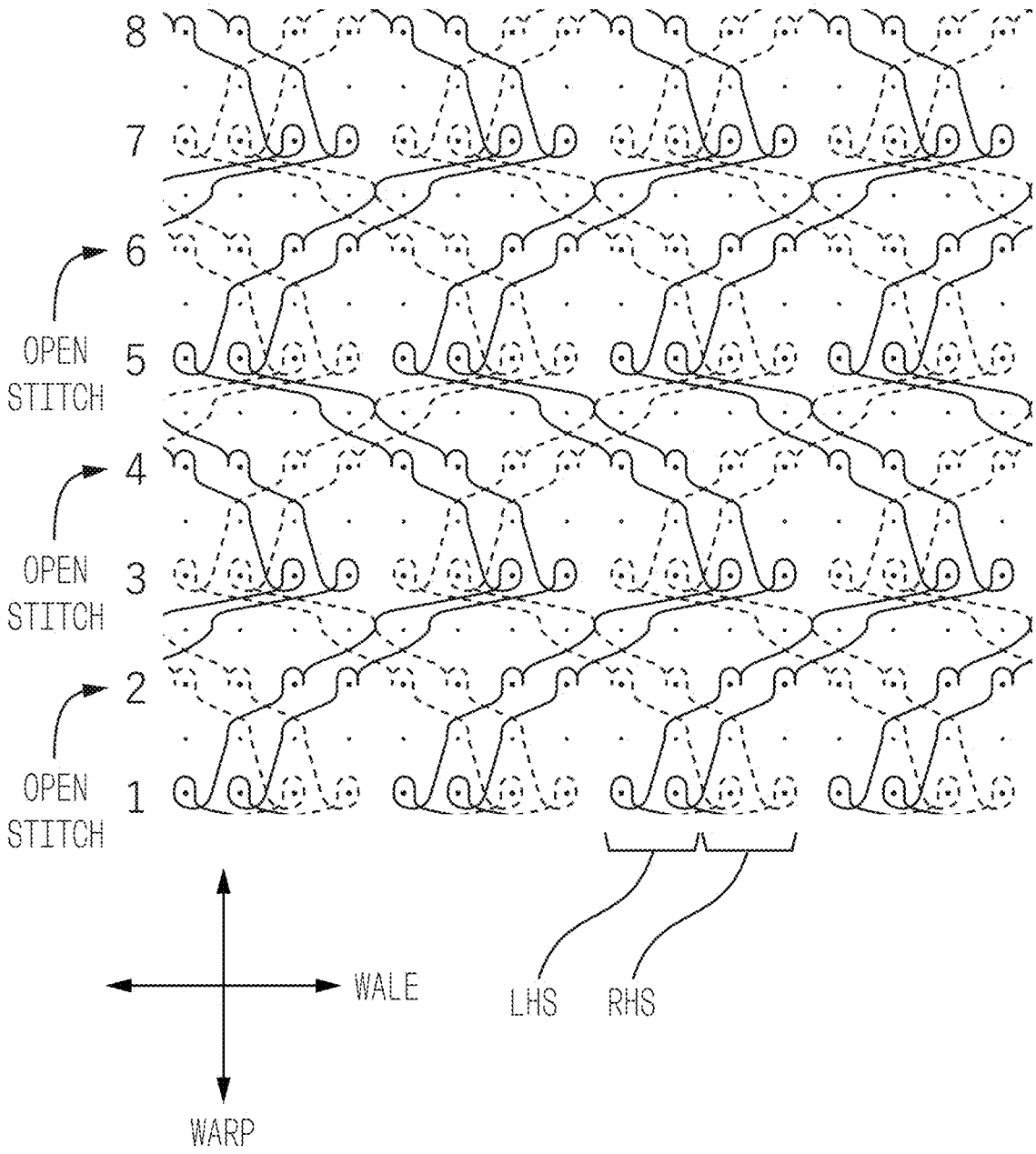
FIG. 4 is a knitting diagram for the double Raschel knitted fabric of Example 2. Each left-half stitch row of a ridge is connected to the ridge that is adjacent to the right of that ridge and each right-half stitch row of a ridge is connected to the ridge that is adjacent to the left of that ridge, with a sinker loop, sandwiching 1 stitch (open stitch).
Figure 5:
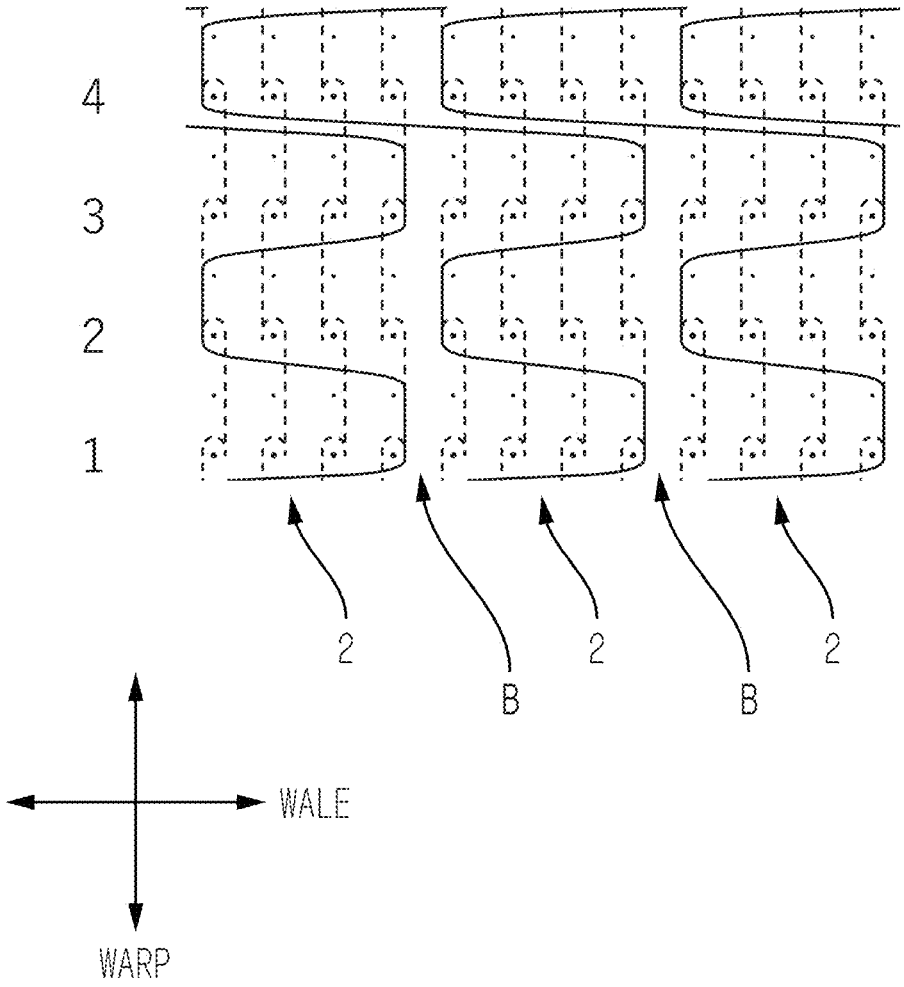
FIG. 5 is a knitting diagram for the double Raschel knitted fabric of Comparative Example 1. The adjacent ridges are not connected by sinker loops (see area B).

FIG. 2 shows an example of a knitted fabric 1 of the embodiment wherein ridges 2 formed by 4 stitch rows in the warp direction and non-ridges 14 having a knitted texture without recesses 3 are repeated, the front layer knitted fabric being shown through the sinker loops, from the connecting layer side. The non-ridges 14 may have any desired knitted texture, but the knitted texture is preferably one needle swing knitting stitch, from the viewpoint of reducing the basis weight. Sinker loop 15, 16 are shown in pattern connecting ridge and non-ridge. The non-ridges 14 that are adjacent in the warp direction will have a higher design property due to more prominent ridge shapes when the gaps A between adjacent ridges are wider, whereas the tensile resistance against the recesses 3 is greater in the course direction (weft direction) when the gaps A are narrower, and therefore in consideration of both of these properties, the gaps between the non-ridges are preferably from 4 courses to 8 courses of separation. From the viewpoint of shape stability, the knitted fabric of the embodiment preferably lacks non-ridges 14, but if non-ridges 14 are formed they are preferably separated as much as possible, and specifically are preferably separated by 4 or more courses and more preferably 8 or more courses.

The material for the fibers used in the front layer knitted fabric is not restricted, and it may be a single type of material or multiple materials combined by plying, combined twisting, mixed spinning or mixed knitting, although long fibers of polyethylene terephthalate are preferred from the viewpoint of raw yarn strength and light fastness. From the viewpoint of inhibiting glare on the knitted fabric surface, the polyethylene terephthalate fibers are preferably false twisted yarn, interlaced yarn or twisted thread.

The fineness of the fibers used for the front layer knitted fabric is preferably a fineness of 100 decitex to 350 decitex, for increased seam strength. From the same viewpoint, the total fineness per single stitch composed of the fibers of the front layer knitted fabric is preferably 150 decitex to 800 decitex.

When the fibers used in the front layer knitted fabric are multifilaments, the single fiber fineness is preferably 1 decitex to 6 decitex, and more preferably 3 decitex to 6 decitex, which provide higher monofilament strength.

The fibers used for the connecting thread are preferably monofilaments. When monofilaments are used as the connecting thread, the fineness is preferably 30 decitex to 300 decitex and more preferably 50 decitex to 250 decitex, in order to inhibit protrusion of the monofilaments onto the knitted fabric surface and maintain a satisfactory cushioning property.

In the double Raschel knitted fabric of the embodiment, in order to cause heat and humidity to migrate from the human body while sitting to provide satisfactory coolness and stuffiness resistance when the fabric is used as a surface covering material for a seat, the air permeability from the connecting layer between the front/back double-layer knitted fabrics of the double Raschel knitted fabric (hereunder also referred to simply as "connecting layer") toward the front layer knitted fabric is preferably 50 cc/cm2/sec or greater and more preferably 60 cc/cm2/sec or greater.

As used herein, the phrase "air permeability from the connecting layer side between the front/back double-layer knitted fabrics of the double Raschel knitted fabric, toward the front layer knitted fabric" means the air permeability of the double Raschel knitted fabric measured under the suction conditions of the air permeability test method (Method A) of JIS L1096, with a double Raschel knitted fabric test piece size of 15 cm-square set on the opening of the air permeability tester with the front layer knitted fabric facing downward, and a 3 mm-thick, 20 cm-square silicon rubber plate placed over the outer surface of the back layer knitted fabric to shield air from passing through the back layer knitted fabric, while allowing air to enter through the four sided cross-section of the double Raschel knitted fabric and pass through the connecting layer to permeate the front layer knitted fabric.

In order to increase the air permeability from the connecting layer side toward the front layer knitted fabric of the double Raschel knitted fabric, it is especially effective to reduce pressure loss during passage of air through the connecting layer, and for this purpose it is preferred to relatively reduce the number of connecting threads forming the connecting layer of the double Raschel knitted fabric, with respect to the number of stitches of the front layer knitted fabric. From the same viewpoint, the number of stitches of connecting thread woven into the front layer knitted fabric of the double Raschel knitted fabric for this embodiment is preferably ¼ to ½ of the total number of stitches in the front layer knitted fabric. The total number of stitches in the front layer knitted fabric is the number of stitches in a 2.54 cm-square piece of front side knitted fabric and can be calculated as the product of the number of courses/2.54 cm and the number of wales/2.54 cm.

The air permeability from the back layer knitted fabric through the front layer knitted fabric of the double Raschel knitted fabric, as generally measured according to the air permeability test method (Method A) of JIS L1096, is preferably 50 cc/cm$^2$/sec or greater.

The fibers used to form the double Raschel knitted fabric may be of any desired material, optionally with different fiber materials in combination, but 100% polyethylene terephthalate fibers are preferred for the front layer knitted fabric, connecting thread and back layer knitted fabric from the viewpoint of material recycling or chemical recycling. Such fibers may be undyed, but it is preferred to use mass-colored filaments or colored yarn to reduce changes in properties of the double Raschel knitted fabric during dyeing. It is even more preferred to use mass-colored filaments kneaded with a dye or the like in order to eliminate the need for a dyeing step.

The thickness of the double Raschel knitted fabric forming the surface covering material of the embodiment may be set as desired, but it is preferably 3 mm to 12 mm and more preferably 3 mm to 8 mm, from the viewpoint of sewability and handleability of the surface covering material. The basis weight of the double Raschel knitted fabric may also be set as desired but is preferably 400 to 1000 g/m$^2$ and more preferably 400 to 900 g/m$^2$.

When the double Raschel knitted fabric uses colored yarn or raw-dyed yarn, the method of finishing the double Raschel knitted fabric forming the surface covering material of the embodiment may be finishing by passing the greige through steps such as scouring and heat setting, but finishing by heat setting alone is preferred from the viewpoint of process simplification. For a double Raschel knitted fabric wherein all of the fibers used for the front/back double-layer knitted fabrics or connecting thread or the front and back double-layer knitted fabric are uncolored, the greige may be finished by being processed by steps such as presetting, scouring, dyeing and heat setting.

The double Raschel knitted fabric of the embodiment can be used in a seat sheet or an surface covering material for an automobile, optionally with urethane laminated on the back side similar to conventional surface covering materials, but it is preferably used without lamination from the viewpoint of the recycling property.

EXAMPLES

The present invention will now be explained in more specific detail through the following Examples and Comparative Example, with the understanding that the invention is in no way limited to the Examples.

The following methods were used to measure the physical properties of the double Raschel knitted fabrics used in the Examples.

(a) Gap a Between Adjacent Ridges (mm)

A VR-3000 one-shot 3D microscope by Keyence Corp. is used to observe the outer surface of the front layer knitted fabric of the obtained double Raschel knitted fabric at a magnification of 25× to 38×, with auto-focus and 3D measurement. Using point-to-point distance function in plane measurement, the shortest distance between adjacent stitches where adjacent stitch rows formed recesses across gaps is measured with a microscope, recording the shortest value. The measurement is conducted at 5 locations and the average is calculated. When the number of courses of recesses is less than 5, all of the shortest distances between adjacent stitches are measured and the average is calculated.

(b) Seam Strength

Three sets of test pieces are prepared from the obtained double Raschel knitted fabric, with two in each set taken from the warp and weft (total of two) directions, each with a width of 100 mm and a length of 100 mm. Aligning the lengthwise directions of the two test pieces in the same direction, the front sides are stacked and sewn at a location 6 mm from the edge. The polyester #8 sewing thread and a #21-S sewing needle by Organ Needle KK. are used for sewing under conditions with a seam pitch of 25±2/100 mm. Each sewn test piece is mounted in a constant speed elongating tensile tester using a grip with a grip spacing of 76±1.0 mm and a width of 25.4×25.4 mm on the front and 25.4 mm×50.8 mm on the back. The test piece is pulled at 200 mm/min and the load (N) required for breaking is measured.

(c) Amount of Tensile Deformation in Recesses (Tensile Resistance of Recesses)

Three 50 mm warp, 260 mm weft test pieces are taken from the obtained double Raschel knitted fabric. The gaps between adjacent ridges in each test piece are measured by the method of (a) above. After using a tensile tester to apply a load of 147.1 N at a pull rate of 50 mm/min onto the open test piece using a grip with a grip spacing of 100 mm, the test piece is removed from the grip and held for 1 hour, subsequently measuring the gap between adjacent ridges again by the method of (a) above, and calculating the amount of deformation of the recesses by the following formula:

Amount of tensile deformation of recesses (mm)= Gap between adjacent ridges before tension (mm)−gap between adjacent ridges after tension (mm), and recording the average value for 3 test pieces. A smaller amount of tensile deformation indicates higher tensile resistance of the recesses.

(d) Design Property of Ridges and Recesses (Shape Stability)

The ridge shapes in the obtained double Raschel knitted fabric were visually evaluated, judging the grade on the following scale as evaluation of the shape stability.

G: Clear formation of ridges without collapse of ridge shapes.

F: Some collapse of ridge shapes, such as pattern deviation, but satisfactory design property P: Definite collapse of ridge shapes, unsatisfactory design property

Example 1

An 18-gauge double Raschel knitting machine having 6 guide bars and 7 mm trick plate distance was used to supply false twisted yarn of 222 dtex (decitex), 72 filament polyethylene terephthalate fibers (black raw-dyed yarn) from two guide bars (L1, L2) for formation of the front layer knitted fabric, doubling the yarns in a 2-in, 2-out (L1) and 2-in, 2-out (L2) arrangement, to supply a monofilament of 89 dtex polyethylene terephthalate fibers (black raw-dyed yarn) from two guide bars (L3, L4) for formation of the connection part in a 2-in, 2-out (L3) and 2-in, 2-out (L4) arrangement, and to further supply false twisted yarn of 167 dtex, 36 filament polyethylene terephthalate fibers (black raw-dyed yarn) from two guide bars (L5, L6), for formation of the back layer knitted fabric, in an all-in array.

A greige for a double Raschel knitted fabric having the following knitted texture was knitted with a machine course of 30 course/2.54 cm. The obtained greige was dry heat set at 175° C.×1 minute with 0% width expansion and a 0% overfeed rate to obtain a double Raschel knitted fabric having the properties listed in Table 1.

(Knitted Texture)

L1: 1033/6733/(2-in, 2-out)
L2: 6733/1033/(2-in, 2-out)
L3: 1043/6734/(2-in, 2-out)
L4: 6734/1043/(2-in, 2-out)
L5: 0001/1110/(all-in)
L6: 2234/2210/(all-in)

Example 2

An 18-gauge double Raschel knitting machine having 6 guide bars and 7 mm trick plate distance was used to supply false twisted yarn of 222 dtex, 72 filament polyethylene terephthalate fibers (black raw-dyed yarn) from two guide bars (L1, L2) for formation of the front layer knitted fabric, doubling the yarns in a 2-in, 2-out (L1) and 2-out, 2-in (L2) arrangement, to supply a monofilament of 89 dtex polyethylene terephthalate fibers (black raw-dyed yarn) from two guide bars (L3, L4) for formation of the connection part in a 2-in, 2-out (L3) and 2-out, 2-in (L4) arrangement, and to further supply false twisted yarn of 167 dtex, 36 filament polyethylene terephthalate fibers (black raw-dyed yarn) from two guide bars (L5, L6), for formation of the back layer knitted fabric, in an all-in array.

A greige for a double Raschel knitted fabric having the following knitted texture was knitted with a machine course of 30 course/2.54 cm. The obtained greige was dry heat set at 175° C.×1 minute with 0% width expansion and a 0% overfeed rate to obtain a double Raschel knitted fabric having the properties listed in Table 1.

(Knitted Texture)

L1: 1011/2344/6766/5433/(2-in, 2-out)
L2: 8988/7655/3233/4566/(2-out, 2-in)
L3: 6734/1043/(2-in, 2-out)
L4: 3265/8956/(2-out, 2-in)
L5: 0001/1110/(all-in)
L6: 2234/2210/(all-in)

Example 3

An 18-gauge double Raschel knitting machine having 6 guide bars and 7 mm trick plate distance was used to supply false twisted yarn of 222 dtex, 72 filament polyethylene terephthalate fibers (black raw-dyed yarn) from two guide bars (L1, L2) for formation of the front layer knitted fabric, doubling the yarns in a 2-in, 2-out (L1) and 2-out, 2-in (L1) arrangement, to supply a monofilament of 89 dtex polyethylene terephthalate fibers (black raw-dyed yarn) from two guide bars (L3, L4) for formation of the connection part in a 2-in, 2-out (L3) and 2-out, 2-in (L4) arrangement, and to further supply false twisted yarn of 167 dtex, 36 filament polyethylene terephthalate fibers (black raw-dyed yarn) from two guide bars (L5, L6), for formation of the back layer knitted fabric, in an all-in array.

A greige for a double Raschel knitted fabric having the following knitted texture was knitted with a machine course of 30 course/2.54 cm. The obtained greige was dry heat set at 175° C.×1 minute with 0% width expansion and a 0% overfeed rate to obtain a double Raschel knitted fabric having the properties listed in Table 1.

(Knitted texture)

L1: 1011/2322/1011/2322/1011/2322/1011/2333/6766/5455/6766/5455/6766/5455/6766/5444/(2-in, 2-out)

L2: 8988/7677/8988/7677/8988/7677/8988/7666/3233/4544/3233/4544/3233/4544/3233/4555/(2-out, 2-in)

L3: 6734/1043/(2-in, 2-out)

L4: 3265/8956/(2-out, 2-in)

L5: 0001/1110/(all-in)

L6: 2234/2210/(all-in)

Example 4

An 18-gauge double Raschel knitting machine having 6 guide bars and 7 mm trick plate distance was used to supply false twisted yarn of 222 dtex, 72 filament polyethylene terephthalate fibers (black raw-dyed yarn) from two guide bars (L1, L2) for formation of the front layer knitted fabric, doubling the yarns in a 2-in, 2-out (L1) and 2-out, 2-in (L2) arrangement, to supply a monofilament of 89 dtex polyethylene terephthalate fibers (black raw-dyed yarn) from two guide bars (L3, L4) for formation of the connection part in a 2-in, 2-out (L3) and 2-out, 2-in (L4) arrangement, and to further supply false twisted yarn of 167 dtex, 36 filament polyethylene terephthalate fibers (black raw-dyed yarn) from two guide bars (L5, L6), for formation of the back layer knitted fabric, in an all-in array.

A greige for a double Raschel knitted fabric having the following knitted texture was knitted with a machine course of 30 course/2.54 cm. The obtained greige was dry heat set at 175° C.×1 minute with 0% width expansion and a 0% overfeed rate to obtain a double Raschel knitted fabric having the properties listed in Table 1.

(Knitted Texture)

L1: 1011/2344/6766/5433/1011/2344/6766/5433/1011/3233/(2-in, 2-out)

L2: 8988/7655/3233/4566/8988/7655/3233/4566/8988/10111010/(2-out, 2-in)

L3: 6734/1043/6734/1043/6734/1043/6734/1043/7689/7678/(2-in, 2-out)

L4: 3265/8956/3265/8956/3265/8956/3265/8956/3256/6745 (2-out, 2-in)

L5: 0001/1110/(all-in)

L6: 2234/2210/(all-in)

Example 5

An 18-gauge double Raschel knitting machine having 6 guide bars and 7 mm trick plate distance was used to supply false twisted yarn of 222 dtex, 72 filament polyethylene terephthalate fibers (black raw-dyed yarn) from two guide bars (L1, L2) for formation of the front layer knitted fabric, doubling the yarns in a 2-in, 2-out (L1) and 2-out, 2-in (L2) arrangement, to supply a monofilament of 89 dtex polyethylene terephthalate fibers (black raw-dyed yarn) from two guide bars (L3, L4) for formation of the connection part in a 2-in, 2-out (L3) and 2-out, 2-in (L4) arrangement, and to further supply false twisted yarn of 167 dtex, 36 filament polyethylene terephthalate fibers (black raw-dyed yarn) from two guide bars (L5, L6), for formation of the back layer knitted fabric, in an all-in array.

A greige for a double Raschel knitted fabric having the following knitted texture was knitted with a machine course of 30 course/2.54 cm. The obtained greige was dry heat set at 175° C.×1 minute with 0% width expansion and a 0% overfeed rate to obtain a double Raschel knitted fabric having the properties listed in Table 1.

(Knitted texture)

L1: 1011/2344/6766/5433/1011/3233/(2-in, 2-out)

L2: 8988/7655/3233/4566/8988/10111010/(2-out, 2-in)

L3: 6734/1043/6734/1043/7689/7678/(2-in, 2-out)

L4: 3265/8956/3265/8956/3256/6745/(2-out, 2-in)

L5: 0001/1110/(all-in)

L6: 2234/2210/(all-in)

Example 6

An 18-gauge double Raschel knitting machine having 6 guide bars and 7 mm trick plate distance was used to supply false twisted yarn of 222 dtex, 72 filament polyethylene terephthalate fibers (black raw-dyed yarn) from two guide bars (L1, L2) for formation of the front layer knitted fabric, doubling the yarns in a 2-in, 2-out (L1) and 2-out, 2-in (L2) arrangement, to supply a monofilament of 89 dtex polyethylene terephthalate fibers (black raw-dyed yarn) from two guide bars (L3, L4) for formation of the connection part in a 2-in, 2-out (L3) and 2-out, 2-in (L4) arrangement, and to further supply false twisted yarn of 167 dtex, 36 filament polyethylene terephthalate fibers (black raw-dyed yarn) from two guide bars (L5, L6), for formation of the back layer knitted fabric, in an all-in array.

A greige for a double Raschel knitted fabric having the following knitted texture was knitted with a machine course of 30 course/2.54 cm. The obtained greige was dry heat set at 175° C.×1 minute with 0% width expansion and a 0% overfeed rate to obtain a double Raschel knitted fabric having the properties listed in Table 1.

(Knitted Texture)

L1: 1011/2344/6766/5433/1011/2344/6766/5433/1011/3233/4566/8988/7655/3233/4566/8988/7655/3233/(2-in, 2-out)

L2: 8988/7655/3233/4566/8988/7655/3233/4566/8988/10111010/9877/5455/6788/10111010/9877/5455/6788/10111010/(2-out, 2-in)

L3: 6734/1043/6734/1043/6734/1043/6734/1043/6765/8956/3265/8956/3265/8956/3265/8956/3265/6765/(2-in, 2-out)

L4: 3265/8956/3265/8956/3265/8956/3265/8956/3256 5487/101178/5487/101178/5487/101178/5487/101178/5478/(2-out, 2-in)

L5: 0001/1110/(all-in)

L6: 2234/2210/(all-in)

Example 7

A 22-gauge double Raschel knitting machine having 6 guide bars and 6 mm trick plate distance was used to supply false twisted yarn of 222 dtex, 72 filament polyethylene terephthalate fibers (black raw-dyed yarn) from two guide bars (L1, L2) for formation of the front layer knitted fabric, doubling the yarns in a 1-in, 1-out (L1) and 1-out, 1-in (L2) arrangement, to supply a monofilament of 89 dtex polyethylene terephthalate fibers (black raw-dyed yarn) from two guide bars (L3, L4) for formation of the connection part in a 1-in, 1-out (L3) and 1-in, 1-out (L4) arrangement, and to further supply false twisted yarn of 167 dtex, 36 filament polyethylene terephthalate fibers (black raw-dyed yarn) from two guide bars (L5, L6), for formation of the back layer knitted fabric, in an all-in array.

A greige for a double Raschel knitted fabric having the following knitted texture was knitted with a machine course of 35 course/2.54 cm. The obtained greige was dry heat set at 175° C.×1 minute with 0% width expansion and a 0% overfeed rate to obtain a double Raschel knitted fabric having the properties listed in Table 1.

(Knitted Texture)

L1: 2111/4555/(1-in, 1-out)

L2: 3444/1000/(1-out, 1-in)

L3: 4521/4367/(1-in, 1-out)

L4: 4367/4521/(1-in, 1-out)

L5: 0001/1110/(all-in)

L6: 0034/4410/(all-in)

Example 8

An 18-gauge double Raschel knitting machine having 6 guide bars and 7 mm trick plate distance was used to supply false twisted yarn of 222 dtex, 72 filament polyethylene terephthalate fibers (black raw-dyed yarn) from two guide bars (L1, L2) for formation of the front layer knitted fabric, doubling the yarns in a 2-in, 2-out (L1) and 2-out, 2-in (L2) arrangement, to supply a monofilament of 89 dtex polyethylene terephthalate fibers (black raw-dyed yarn) from two guide bars (L3, L4) for formation of the connection part in a 2-in, 2-out (L3) and 2-out, 2-in (L4) arrangement, and to further supply false twisted yarn of 167 dtex, 36 filament polyethylene terephthalate fibers (black raw-dyed yarn) from two guide bars (L5, L6), for formation of the back layer knitted fabric, in an all-in array.

A greige for a double Raschel knitted fabric having the following knitted texture was knitted with a machine course of 30 course/2.54 cm. The obtained greige was dry heat set at 175° C.×1 minute with 0% width expansion and a 0% overfeed rate to obtain a double Raschel knitted fabric having the properties listed in Table 1.

(Knitted Texture)

L1:5455/6766/5455/6766/5455/6766/5455/6766/5444/1011/2322/1011/2322/1011/2322/1011/2322/1033 (2-in, 2-out)

L2:2322/1011/2322/1011/2322/1011/2322/1011/2333/6766/5455/6766/5455/6766/5455/6766/5455/6744 (2-out, 2-in)

L3:6734/1043/6734/1043/6734/1043/6734/1043/7689/7678/(2-in, 2-out)

L4:3265/8956/3265/8956/3265/8956/3265/8956/3256/6745 (2-out, 2-in)

L5: 0001/1110/(all-in)

L6: 2234/2210/(all-in)

Comparative Example 1

An 18-gauge double Raschel knitting machine having 6 guide bars and 7 mm trick plate distance was used to supply false twisted yarn of 222 dtex, 72 filament polyethylene terephthalate fibers (black raw-dyed yarn) from two guide bars (L2) for formation of the front layer knitted fabric, doubling the yarns in an all-in (L2) arrangement, to supply false twisted yarn of 222 dtex, 72 filament polyethylene terephthalate fibers (black raw-dyed yarn) from a comb (L1) for insertion of insertion thread in the front layer knitted fabric, doubling the yarns in a 1-in/3-out arrangement, to supply a monofilament of 89 dtex polyethylene terephthalate fibers from two guide bars (L3, L4) for formation of the connection part in a 2-in, 2-out (L3) and 2-out, 2-in (L4) arrangement, and to further supply false twisted yarn of 167 dtex, 36 filament polyethylene terephthalate fibers (black raw-dyed yarn) from two guide bars (L5, L6), for formation of the back layer knitted fabric, in an all-in array.

A greige for a double Raschel knitted fabric having the following knitted texture was knitted with a machine course of 30 course/2.54 cm. The obtained greige was dry heat set at 175° C.×1 minute with 0% width expansion and a 0% overfeed rate to obtain a double Raschel knitted fabric having the properties listed in Table 1.

(Knitted Texture)

L1: 0000/4444/0000/8888 (1-in, 3-out)

L2: 1000/0111/(all-in)

L3: 6734/1043/(2-in, 2-out)

L4: 3265/8956/(2-out, 2-in)

L5: 0001/1110/(all-in)

L6: 2234/2210/(all-in)

TABLE 1

| | | Example 1 | Example 2 | Example 3 | Example 4 | Example 5 |
|---|---|---|---|---|---|---|
| Yarn usage | Front layer knitted fabric | PET222/72 Black raw-dyed false-twisted yarn, P2 ply | PET222/72 Black raw-dyed false-twisted yarn, P2 ply | PET222/72 Black raw-dyed false-twisted yarn, P2 ply | PET222/72 Black raw-dyed false-twisted yarn, P2 ply | PET222/72 Black raw-dyed false-twisted yarn, P2 ply |
| | Insertion thread | — | — | — | — | — |
| | Connecting thread | PET89 | PET89 | PET89 | PET89 | PET89 |
| | Back layer knitted fabric | PET167/36 Black raw-dyed false-twisted yarn | PET167/36 Black raw-dyed false-twisted yarn | PET167/36 Black raw-dyed false-twisted yarn | PET167/36 Black raw-dyed false-twisted yarn | PET167/36 Black raw-dyed false-twisted yarn |
| Thickness (mm) | | 6.9 | 7.0 | 7.0 | 6.9 | 6.9 |
| Knitting density | Course number/2.54 cm | 29.8 | 29.5 | 29.7 | 30.5 | 30.5 |
| | Wale number/2.54 cm | 21.0 | 21.3 | 21.5 | 21.5 | 21.0 |
| Basis weight (g/m$^2$) | | 756 | 727 | 742 | 763 | 724 |
| Number of stitches containing sinker loops connecting adjacent ridges | | 0 | 1 | 1 | 1 | 1 |
| Gaps at ridges between sinker loops connected with their adjacent ridges (courses) | | 1 | 3 | 9 | 3 | 3 |
| Non-ridge gaps (courses) | | — | — | — | 8 | 4 |
| Adjacent ridge gaps (mm) | | 2.1 | 0.9 | 1.1 | 0.8 | 0.8 |
| Seam strength | Warp | 696.85 | 690.91 | 685.33 | 645.69 | 802.67 |

TABLE 1-continued

| | | | | | | |
|---|---|---|---|---|---|---|
| (N/25.4 mm) | Weft | 573.96 | 565.79 | 558.64 | 515.01 | 575.27 |
| Amount of tensile deformation in recesses (mm) | | 0.6 | 0.8 | 1.3 | 1.1 | 0.9 |
| Ridge and recess design property (shape stability) | | G | G | G | G | F |
| Air permeability (cc/cm$^2$/sec) | | 84.2 | 82.5 | 78.9 | 73 | 67.1 |
| Air permeability (cc/cm$^2$/sec) from connecting layer through front side knitted fabric | | 55 | 51 | 50 | 52 | 53 |

| | | Example 6 | Example 7 | Example 8 | Comp. Example 1 |
|---|---|---|---|---|---|
| Yarn usage | Front layer knitted fabric | PET222/72 Black raw-dyed false-twisted yarn, P2 ply | PET222/72 Black raw-dyed false-twisted yarn, P2 ply | PET222/72 Black raw-dyed false-twisted yarn, P2 ply | PET222/72 Black raw-dyed false-twisted yarn, P2 ply |
| | Insertion thread | — | — | — | PET222/72 Black raw-dyed false-twisted yarn, P2 ply |
| | Connecting thread | PET89 | PET89 | PET89 | PET89 |
| | Back layer knitted fabric | PET167/36 Black raw-dyed false-twisted yarn | PET167/36 Black raw-dyed false-twisted yarn | PET167/36 Black raw-dyed false-twisted yarn | PET167/36 Black raw-dyed false-twisted yarn |
| Thickness (mm) | | 6.8 | 5.7 | 6.9 | 6.6 |
| Knitting density | Course number/2.54 cm | 28.0 | 35.2 | 29.8 | 29.0 |
| | Wale number/2.54 cm | 22.0 | 23.9 | 21.5 | 20.2 |
| Basis weight (g/m$^2$) | | 724 | 628 | 735 | 711 |
| Number of stitches containing sinker loops connecting adjacent ridges | | 1 | 0 | 1 | — |
| Gaps at ridges between sinker loops connected with their adjacent ridges (courses) | | 3 | 1 | 10 | — |
| Non-ridge gaps (courses) | | 8 | — | — | — |
| Adjacent ridge gaps (mm) | | 0.8 | 0.7 | 1.2 | 0.6 |
| Seam strength (N/25.4 mm) | Warp | 669.36 | 710.49 | 670.00 | 516.55 |
| | Weft | 586.71 | 589.25 | 545.00 | 412.00 |
| Amount of tensile deformation in recesses (mm) | | 1.2 | 0.4 | 1.6 | 2.5 |
| Ridge and recess design property (shape stability) | | G | F | F | G |
| Air permeability (cc/cm$^2$/sec) | | 79.7 | 68.5 | 76.2 | 55.8 |
| Air permeability (cc/cm$^2$/sec) from connecting layer through front side knitted fabric | | 67 | 68 | 48 | 35 |

As shown in Table 1, the double Raschel knitted fabrics of Examples 1 to 8 which had adjacent ridges in the front layer knitted fabric connected together with sinker loops, exhibited higher seam strength and tensile resistance of the recesses compared to Comparative Example 1 which did not have the adjacent ridges connected together by sinker loops.

Furthermore, in Examples 1, 2 and 3, wherein the ridges were formed by stitch rows of 4 or more wales without non-ridges, and Examples 4 and 6 which had non-ridges with non-ridge gaps of 8 courses or greater, the obtained double Raschel knitted fabrics had particularly excellent shape stability of the ridges.

INDUSTRIAL APPLICABILITY

The double Raschel knitted fabric of the invention can be utilized as a surface covering material for cushion members such as urethane pads for seat sheets used in vehicles or furniture, as a surface covering material for seat sheets formed by stretching over sheet frames, or as a surface covering material that can be used as inner surface covering material for a vehicle ceiling or door trimming, exhibiting a three-dimensional design property due to the ridges on the knitted fabric surface, while also inhibiting collapse of the ridges even when subjected to strong tensile load in the course direction (weft direction). When used as a seat sheet, it can serve as a surface covering material to exhibit a high cooling property and stuffiness resistance while sitting.

REFERENCE SIGNS LIST

1 Knitted fabric of layer with ridges
2 Ridge
3 Recess
4 One stitch facing recess
5 Other stitch facing recess
6 Sinker loop
7 Sinker loop
8 Sinker loop
9 Sinker loop
10 Sinker loop
11 Sinker loop
12 Sinker loop
13 Sinker loop
14 Non-ridge
15 Sinker loop in pattern connecting ridge and non-ridge
16 Sinker loop in pattern connecting ridge and non-ridge
A Gap between adjacent ridges

The invention claimed is:

1. A double Raschel knitted fabric including a double-layer knitted fabric, comprising a front layer and a back layer, and connecting thread connecting together the front layer and the back layer, and having a plurality of ridges and recesses between the ridges, formed in at least one of the front layer and the back layer, wherein the ridges are formed by two or more wales of stitch rows gathered together in the warp direction, and each ridge of the plurality of ridges is linked with a respective adjacent ridge on at least one side by a plurality of sinker loops, and which includes in the knitted fabric on at least one of the front layer and the back layer where the ridges are formed, a plurality of non-ridges in which two or more courses composed of a knitted texture without recesses are gathered together, wherein the non-ridges adjacent in the warp direction are separated by two or more courses.

2. The double Raschel knitted fabric according to claim 1, wherein for each ridge of the plurality of ridges, a left-half stitch row is connected to a respective adjacent ridge to the right and a right-half stitch row is connected to a respective adjacent ridge to the left by one sinker loop of the plurality of sinker loops in a manner such that 0 to 1 stitches are formed therebetween.

3. The double Raschel knitted fabric according to claim 1, wherein in each ridge of the plurality of ridges, one or more courses every 3 courses are connected with the respective adjacent ridge by one sinker loop of the plurality of sinker loops in a manner such that 0 to 1 stitches are formed therebetween.

4. The double Raschel knitted fabric according to claim 1, wherein in each ridge of the plurality of ridges, all of the courses are connected with the respective adjacent ridge by one sinker loop of the plurality of sinker loops in a manner such that 0 to 1 stitches are formed therebetween.

5. The double Raschel knitted fabric according to claim 1, wherein an air permeability through the knitted fabric from the back layer toward the front layer is 50 $cc/cm^2/sec$ or greater.

6. A surface covering material which includes the double Raschel knitted fabric according to claim 1.

7. A double Raschel knitted fabric including a double-layer knitted fabric, comprising a front layer and a back layer, and connecting thread connecting together the front layer and the back layer, and having a plurality of ridges and recesses between the ridges, formed in at least one of the front layer and the back layer, wherein the ridges are formed by two or more wales of stitch rows gathered together in the warp direction, and each ridge of the plurality of ridges is linked with a respective adjacent ridge on at least one side by a plurality of sinker loops, and wherein for each ridge of the plurality of ridges, each left-half stitch row is connected to a respective adjacent ridge to the right by one sinker loop of the plurality of sinker loops with no stitches formed therebetween, and each right-half stitch row is connected to a respective adjacent ridge to the left by one sinker loop of the plurality of sinker loops with no stitches formed therebetween.

8. A surface covering material which includes the double Raschel knitted fabric according to claim 7.

* * * * *